US005146168A

United States Patent [19]

Shaland

[11] Patent Number: 5,146,168

[45] Date of Patent: Sep. 8, 1992

[54] VARIABLE SENSITIVITY TIMING ANALYZER

[75] Inventor: Alexander Shaland, Lyndhurst, Ohio

[73] Assignee: Actron Manufacturing Company, Cleveland, Ohio

[21] Appl. No.: 591,619

[22] Filed: Oct. 1, 1990

[51] Int. Cl.[5] ..... F02P 17/00

[52] U.S. Cl. ..... 324/392; 324/384; 324/385; 324/402

[58] Field of Search ..... 324/391, 392, 402, 378, 324/379, 380, 384, 385, 386; 123/644

[56] References Cited

U.S. PATENT DOCUMENTS

| | | | |
|---|---|---|---|
| 3,789,658 | 2/1974 | Olsen . | |
| 3,986,009 | 10/1976 | Fastaia . | |
| 4,095,170 | 6/1978 | Schmitt . | |
| 4,101,822 | 7/1978 | Does et al. . | |
| 4,644,284 | 2/1987 | Friedline et al. . | |
| 4,713,617 | 12/1987 | Michalski | 324/392 X |
| 4,795,979 | 1/1989 | Kreft et al. . | |
| 4,847,563 | 11/1989 | Sniegowski et al. . | |
| 4,937,527 | 6/1990 | Sniegowski et al. . | |
| 4,942,362 | 7/1990 | Lance | 324/391 X |

FOREIGN PATENT DOCUMENTS

| | | | |
|---|---|---|---|
| 1487232 | 6/1967 | France . | |
| 2203253 | 10/1988 | United Kingdom | 324/391 |

OTHER PUBLICATIONS

Kal-Equip Catalog pp. 3-4.

Radio Electronics, vol. 56, Jul., 1985, pp. 55-57, 82.

The Giant Book of Easy to Build Electronic Projects, Dec. 1981.

The Allen Group 32-470 Distributorless Ignition Adaptor Operation Guide, Dec. 1987.

Sun Electric Corporation Engine Analyzer Model DIL 200, Dec. 1987.

*Primary Examiner*—Kenneth A. Wieder

*Attorney, Agent, or Firm*—Calfee, Halter & Griswold

[57] ABSTRACT

A timing analyzer for engine diagnostic testing includes a variable sensitivity knob for testing ignition timing for both a conventional four stroke engine and a DIS four stroke engine. The timing analyzer has a pickup which is adapted to be placed around a lead from a spark plug in the engine. During spark plug firing, a current spike appears in the spark plug lead. The timing analyzer is adapted to be triggered when a current spike above a selected threshold level is detected. When the timing analyzer is triggered, a pulse of light is produced from the nose cone of the analyzer. During engine operation, the spark plugs are continuously being fired, which creates a strobe light effect from the analyzer. The timing analyzer is aimed at timing marks on the engine block, and at a single mark on the rotating flywheel, which permit the engine to be properly timed. The variable sensitivity knob for the timing analyzer is adapted to variably control the threshold level for the analyzer trigger, depending on the particular type of engine being tested. The variable sensitivity knob can select a high sensitivity to test the ignition timing of a DIS four stroke engine, or a low sensitivity to test the ignition timing of a conventional four stroke engine.

14 Claims, 2 Drawing Sheets

VARIABLE SENSITIVITY TIMING ANALYZER

The present invention relates to an analyzer for testing engine timing. More particularly, the invention relates to a timing analyzer having variable sensitivity that allows the analyzer to test both conventional four stroke engines and DIS four stroke engines.

BACKGROUND OF THE INVENTION

Portable timing analyzers are typically used to test the ignition timing of an engine. A timing analyzer typically comprises a simple hand held, gunshaped instrument having a xenon strobe lamp incorporated therein. The analyzer is connected to a spark plug lead from the engine and is adapted to supply a pulse of light when a pre-selected current level in the lead is sensed.

Ignition timing refers to when a spark occurs in the spark plug gap. In a typical internal combustion engine, a set of breaker points alternating opens and closes a primary circuit between the battery, the primary winding of the ignition coil and ground. When the points are closed, the primary circuit is complete and current flows through the circuit. When the points are opened, a collapsing electro-magnetic field around the primary circuit produces a collapsing magnetic field in the adjacent secondary circuit, which is connected to a spark plug. The changing electro-magnetic field in turn produces an increasing voltage in the secondary circuit. When a sufficient voltage is present across the gap in the spark plug, the spark plug fires, whereby a fuel charge in the combustion chamber of the piston is ignited, and a current spike appears in the spark plug lead.

The rapid ignition of the fuel charge in the cylinder forces the piston downward on a power stroke. The piston is mechanically coupled to the crankshaft, which is thereby caused to turn. The fuel charge requires a short period of time to ignite and reach its full power. Consequently, the fuel charge is generally ignited a few degrees before the piston reaches top dead center ("TDC") of the cylinder, so that the burning charge properly forces the piston downward at the point of maximum efficiency.

In order to adjust the spark plug ignition timing so that the spark plug fires a specified number of degrees before the piston reaches TDC, timing marks are generally included on a stationary part of the engine, and a single mark is generally included on the rotating fly wheel. As the crankshaft spins, the fly wheel spins with it. The timing analyzer, which is in electrical contact with the spark plug lead, is triggered each time the spark plug fires, and produces a pulse of light. When the timing analyzer is aimed at the timing marks on the engine, the strobe effect of the pulses of light permits service personnel to align the timing marks on the engine with the rotating mark on the flywheel to establish proper ignition timing. When the engine is properly timed, the mark on the fly wheel lines up with the appropriate timing mark on the engine block.

In an internal combustion engine, and in particular a conventional four stroke engine, the piston completes four strokes within the cylinder during each operating cycle of the engine. For example, a four stroke engine has (1) an intake stroke, (2) a compression stroke, (3) a power stroke, and (4) an exhaust stroke.

On the intake stroke of the four stroke engine, the piston moves toward the bottom of the cylinder and creates a vacuum above it in the cylinder head. A camshaft mechanically coupled to the crankshaft causes an intake valve on the head of the cylinder to open and an exhaust valve to close. The intake valve delivers a air fuel mixture to the cylinder. When the piston begins to move upward in the cylinder during the compression stroke, the intake valve closes and the air fuel mixture is compressed. When the piston nears the upper end the cylinder, the spark plug fires and ignites the mixture. The rapid burning of the fuel forces the piston downward during the power stroke. At the bottom of the power stroke, the exhaust port opens and the exhaust gas flows out the port, assisted by the upwardly moving piston during the exhaust stroke.

Later model engines have a variation of a conventional four stroke engine, which is referred to as a distributorless ignition system ("DIS"). In the DIS four stroke engine, the engine has a series of double ended coils, where each coil fires two spark plugs simultaneously. Each coil is coupled through an ignition module to a timing circuit, which is generally included within an on-board computer. The timing circuit, through the ignition module, produces a current spike in the spark plug lead in much the same way as the set of breaker points produces a current spike in the conventional four stroke engine, however, the current spike is more controlled, both in duration and intensity.

In the DIS four stroke engine, the first spark plug on the coil fires normally in a first cylinder that is on a compression stroke to ignite the fuel charge, while the second spark plug fires a "waste spark" in a second cylinder that is on an exhaust stroke, which does not ignite a fuel charge. Each spark plug lead therefore experiences two current spikes for every cycle—one current spike for the power stroke and one current spike for the exhaust stroke.

Moreover, the ignition system of the DIS four stroke engine is more efficient than the ignition system of the conventional four stroke engine. The amplitude and duration of the current in the primary windings of the ignition coils are closely controlled in the DIS four stroke engines. Consequently, the current needed to fire each spark plug in the DIS engine is reduced.

In a conventional four stroke engine, the lead from the spark pug carries the large current spike from the spark plug firing and various secondary current spikes caused form "noise" in the system—typically noise caused by other cylinders. Consequently, the trigger in the timing analyzer must be set to a relatively high level for a conventional four stroke engine to trigger only during the actual spark plug ignition.

However, in the more advanced DIS four stroke engine, the current spikes from the compression stroke and the exhaust stroke are relatively smaller. Additionally, there is less noise through the spark plug lead than in a conventional four stroke engine. Consequently, if a conventional four stroke timing analyzer is used on a DIS four stroke engine, the timing analyzer may not operate correctly because the current spikes in the DIS four stroke engine might not be high enough to trigger the analyzer.

Moreover, service personnel are typically trained to visually check the rate of light pulses emanating from the timing analyzer before testing ignition timing to roughly determine if the analyzer is operating properly. If a conventional four stroke timing analyzer is used on a DIS four stroke engine, the service personnel would observe twice the rate of light pulses emanating from the timing analyzer, since the spark plugs in a DIS engine fire twice as fast as a conventional four stroke engine. Consequently, service personnel can become confused by the increased rate of light pulses and can believe that the timing analyzer is not operating properly.

Prior art timing analyzers have so far failed to overcome the aforementioned problems. It is known in the timing analyzer art to provide analyzers with a two position switch, whereby in one position, the switch slightly increases the sensitivity of the timing analyzer by lowering the trigger threshold, and in the other position, the switch slightly decreases the sensitivity of the timing analyzer by increasing the trigger threshold. However, these prior art timing analyzers are primarily designed to compensate for different current trigger levels in conventional four stroke engines, and are not designed for the considerably lower current threshold in the DIS four stroke engine. Moreover, the prior art timing analyzers do not allow flexibility in setting the trigger to properly respond to different current threshold levels, so as to manually select a desired usable threshold level.

SUMMARY OF THE INVENTION

The present invention provides a new construction for an electronic timing analyzer which provides for variable sensitivity to select the proper trigger threshold for either a conventional or DIS four stroke engine.

According to one aspect of the invention, the timing analyzer comprises a housing having a xenon strobe lamp, a trigger, a power supply connection and an inductive pickup connection. The analyzer includes a variable sensitivity knob adapted to provide a variable level of triggering for the analyzer, as discussed herein in more detail.

The power supply connection is connected to the vehicle battery to supply power to the analyzer. The pickup is attached to a spark plug lead to inductively sense the current in the spark plug lead. When the current in the lead is above a selected threshold value, such as when the spark plug is fired, the timing analyzer is triggered and produces a pulse of light. The pulse of light is aimed at the timing marks on the engine and at the single mark on the rotating flywheel to determine if the ignition timing is properly set.

The timing analyzer includes a variable sensitivity knob that allows the threshold level of the analyzer to be varied depending on the type of vehicle being tested, such as a conventional or DIS four stroke engine. The timing analyzer is adapted to be triggered by both the smaller current levels in the DIS four stroke engine, as well as by the larger current levels in the conventional four stroke engine. Moreover, the timing analyzer can be adjusted to trigger only on the current spikes in the DIS four stroke engine that occur during the compression stroke, and not on the current spikes that occur during the exhaust stroke, so that the timing analyzer provides the same rate of light pulses for both a conventional four stroke and a DIS four stroke engine at equal engine speeds.

Further features and advantages of the present invention will become apparent from the following detailed description and the accompanying drawings.

DETAILED DESCRIPTION OF THE PREFERRED EMBODIMENT

Figure 1:
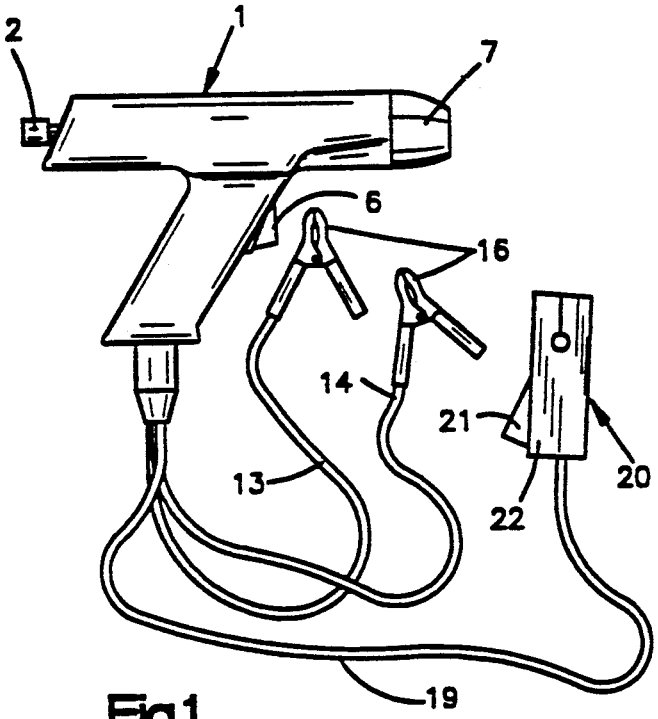
FIG. 1 is a side view of the timing analyzer made in accordance with the present invention.

Referring to the drawings, and initially to FIG. 1, there is illustrated a timing analyzer, indicated generally at 1, having a variable sensitivity knob 2 made in accordance with the present invention.

A conventional timing analyzer includes a left side housing portion 4 and a right side housing portion 5 (FIG. 2) which cooperatively mate together to form an enclosure therewithin. The enclosure is substantially gun-shaped, and has a trigger switch 6 and a rubber nose cone 7.

Figure 3:
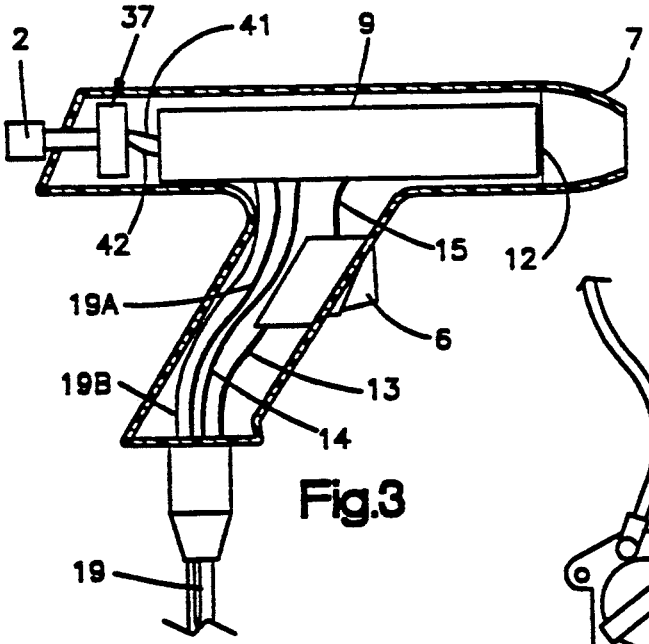
FIG. 3 is a cross-sectional view of the timing analyzer of FIG. 1 illustrating the electrical components in the analyzer.
Figure 5:
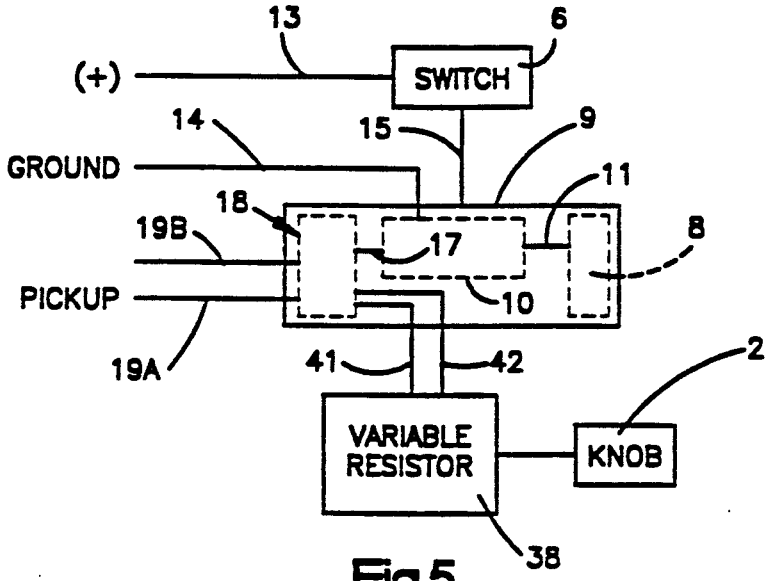
FIG. 5 is a schematic illustration of the circuit and control components of a timing analyzer made in accordance with the present invention.

As schematically illustrated in FIG. 5, the enclosure contains a xenon strobe lamp 8 mounted on a circuit board 9, which is adapted to produce a pulse of light through the nose cone of the analyzer. The enclosure further contains a plurality of electrical components 10 mounted on the circuit board 9, such as, for example, resistors, capacitors, integrated circuits and the like. The electrical components are in electrical contact with the xenon strobe lamp 8. When lamp 8 produces a pulse of light, the light is focused through lens 12 and shines out nose cone 7 (FIG. 3).

The trigger switch 6 (FIG. 3) partially extends through the enclosure and, when manually depressed, is adapted to allow power to flow from the power supply leads 13, 14 to the electrical components 10. Lead 13 is connected from the positive terminal of the vehicle battery through trigger switch 6 and lead 15 to the electrical components. Lead 14 is connected from the ground terminal of the vehicle battery to the electrical components. The power supply connections 13, 14 are conventional in design, and terminal clamps 16 (FIG. 1) at the free ends thereof are adapted to be connected to the positive and ground terminals of the battery during operation of the timing analyzer.

The electrical components are also connected through lead 17 to a trigger circuit, indicated generally at 18, which will be described herein in more detail. Trigger circuit 18 in turn is connected through lead 19 to a pickup, shown generally at 20 in FIG. 1. Lead 19 includes signal lead 19A and ground lead 19B (FIG. 3). Lead 19B grounds the shield on signal lead 19A, and is connected to the circuit board 9.

Figure 4:
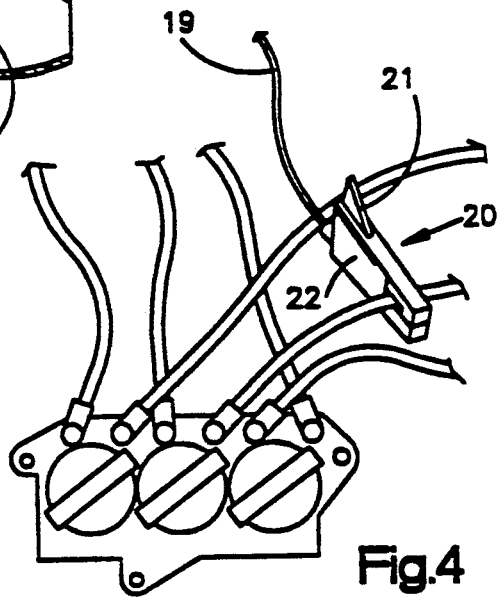
FIG. 4 is a schematic illustration of an internal combustion engine with portions omitted illustrating a pickup applied to a spark plug lead from an ignition coil.

The pickup 20 is adapted to be clamped around the #1 spark plug lead, for example as shown in FIG. 4. The pickup 20 is conventional in design and has two arms 21, 22 that clamp around the outer insulated covering to the spark plug lead. Each arm 21, 22 has a ferrite core (not shown) disposed therein which is adapted to inductively sense the current in the leads. Lower arm 22 has a coil of wire around the ferrite core which is connected to lead 19A, which is in turn connected to the trigger circuit 18 in the timing analyzer.

During the operation of the engine, the spark plugs alternately fire to ignite the fuel charge to drive the pistons within their chambers. Specifically, a spark plug initially ignites the air fuel mixture and causes the mixture to burn rapidly and drive the piston in the chamber during the power stroke. In a conventional four stroke engine, the spark plugs fire once for every two times the piston moves to the upper end of the cylinder. Alternatively, in a DIS four stroke engine, the spark plugs fire once each time the piston moves to the upper end of the cylinder.

In a conventional four stroke engine, the spark plugs are ignited by an ignition coil, which is connected to all the spark plug leads through a distributor, and selectively provides a voltage spike to each spark plug. Alternatively, in a DIS four stroke engine, an electronic ignition circuit in an on-board computer, in conjunction with an ignition module, controls the ignition coils. Each ignition coil is permanently attached to two spark plug leads and provides high voltage spikes to both spark plugs simultaneously.

A high voltage spike in a spark plug produces an arc across the spark plug gap, which in turn ignites the fuel mixture. A current spike appears in the spark plug lead after the arc is created. The current spike in the lead creates a changing electro-magnetic field. The inductive pickup 20 is adapted to sense the current spike in the spark plug lead. The pickup applies the current spike through lead 19A to the input of the timing analyzer. If the current spike is above a selected threshold level, as described in more detail herein, the timing analyzer produces a pulse of light through the nose cone of the analyzer.

The level of voltage applied across the spark plug gap is a function of the dielectric strength in the spark plug gap. For example, in a DIS four stroke engine, when the cylinder is under compression, the dielectric strength in the spark plug gap is large and a substantial voltage is required to fire the spark plug, typically in the 15 kilovolt range. However, when the cylinder is on the exhaust stroke, the dielectric strength across the spark plug gap is small and the spark plug fires at a relatively low voltage value, typically in the 1.5 kilovolt range.

The level of the current spike in a spark plug lead is dependent upon the type of engine being tested. In the DIS four stroke engine, the current spike in the spark plug lead during the compression stroke is slightly higher than the current spike in the spark plug lead during the exhaust stroke. Additionally, all the current spikes in the conventional four stroke engine are relatively larger than any of the current spikes in the DIS four stroke engine. Moreover, the secondary current spikes in the spark plug leads in a conventional four stroke engine caused by "noise" from other cylinders are also higher than in a DIS engine.

Consequently, the trigger level for a conventional four stroke engine must be set at a relatively high level to permit an accurate sequence of light pulses to be emitted from the timing analyzer during spark plug firing, and to reject the current spikes caused by "noise" in the leads. However, the current spikes in the DIS four stroke engine are relatively small, and the level of "noise" on the line is reduced. Therefore, the trigger level in the timing analyzer must be set at relatively low level for the DIS four stroke engine. Moreover, to properly trigger only on the slightly higher current spikes created during the compression stroke in the DIS four stroke engine, the timing analyzer must have a variable trigger level to manually select the slightly higher compression spike and reject the slightly lower exhaust spike.

Accordingly, as shown in FIG. 5, a variable sensitivity knob 2 and associated circuitry are included in the timing analyzer. The knob is in registering relationship with the trigger circuit 18 to allow the trigger level for the timing analyzer to be varied depending on whether a conventional or DIS four stroke engine is being tested.

Figure 6:
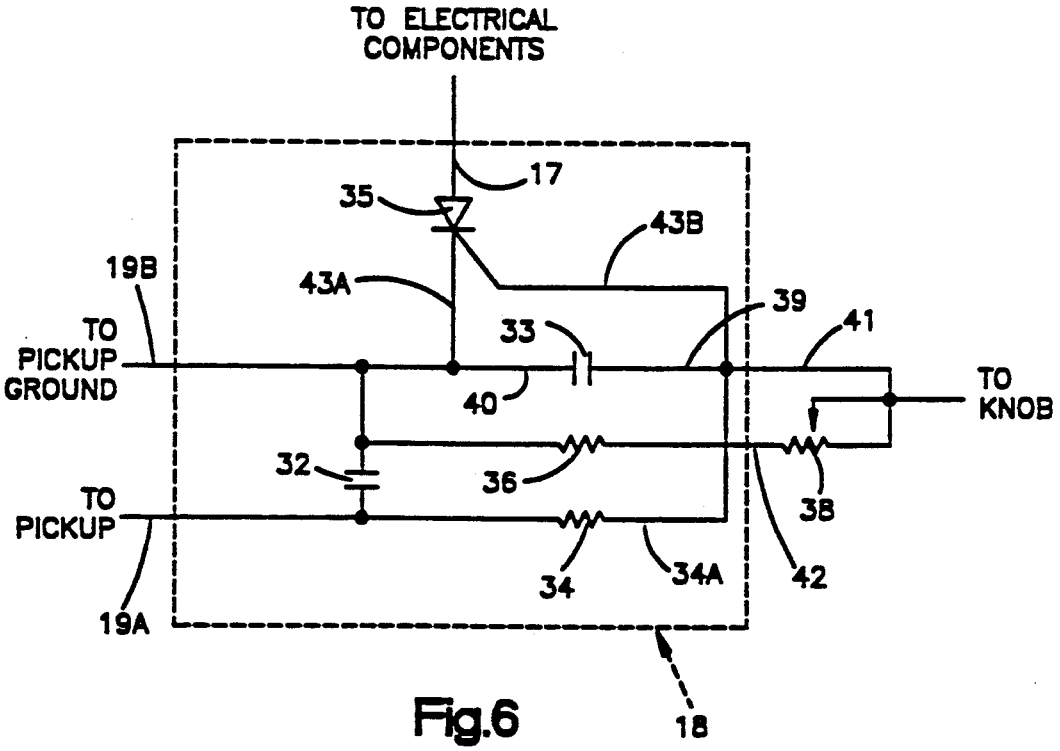
FIG. 6 is an electrical circuit diagram of the trigger circuit made in accordance with the present invention.

As shown in detail in FIG. 6, the trigger circuit 18 comprises capacitors 32, 33, resistors 34, 36 and silicon controlled rectifier (SCR) 35. Additionally, variable resistor 38 is connected in series with resistor 36, and is manually controlled by knob 2. The preferred value for resistors 34 and 36 is 100 Ohms, while the preferred value for capacitors 32 and 33 is 0.0033 μf, and 0.0015 μf, respectively. The variable resistor 38 preferably has a maximum value of 25 K Ohms.

Capacitor 32 in the trigger circuit is connected between lead 19A and ground lead 19B. Capacitor 33 is connected by conductor 39 to the gate of SCR 35, and by conductor 40 to ground. Resistor 36 is connected between ground lead 19B, capacitor 32 and variable resistor 38, while resistor 34 is connected between lead 19A, capacitor 32, and the gate of SCR 35 through conductor 43B. Variable resistor 38 is connected to capacitor 33 and lead 40 to SCR 35 by lead 41 and to resistor 36 by lead 42.

SCR 35 has its cathode connected to ground lead 19B through conductor 43A and its anode connected to the electrical components in the timing analyzer by conductor 17. The gate of the SCR through lead 43B is connected to capacitor 33, resistor 34 and variable resistor 38. When SCR 35 is triggered, as described herein in more detail, a high voltage trigger pulse is applied to the strobe lamp 8, which causes the lamp to emit a pulse of light.

The trigger circuit operates in the following manner. A current spike is applied from the pickup through lead 19A to the trigger circuit 18, as shown in FIG. 6. Capacitor 32 acts to filter any noise on the lead, as well as to create a resonance circuit. Capacitor 32 in effect adapts the circuit to the particular signal polarity present in lead 19A to the trigger circuit, so that the circuit operates independently of the polarity of the signal. Resistor 34 and capacitor 33 further filter the signal through the circuit, as well as protect the SCR against direct DC current spikes caused by improperly connecting the leads to the timing analyzer. Resistor 34 is connected in series with the gate of the SCR 35, while resistors 36, 38 are connected in parallel with the gate of SCR 35, and are adapted to vary the current applied through lead 43B to the gate of SCR 35 depending upon the setting of variable resistor 38.

The variable sensitivity knob 2 controls the threshold level of the trigger circuit in the timing analyzer by controlling the resistance value of variable resistor 38. For example, to increase the threshold level of the trigger circuit, variable resistor 38 is manually adjusted through knob 2 so that its resistance is decreased, which thereby decreases the current applied to the gate of SCR 35. Accordingly, a higher current spike through pickup 19A is necessary to trigger the SCR and produce a pulse of light from the timing analyzer. Similarly, if knob 2 is adjusted to increase the resistance to SCR 35, the current applied to the gate of SCR 35 is increased and a lower current spike through pickup 19A will trigger the SCR.

Figure 2:
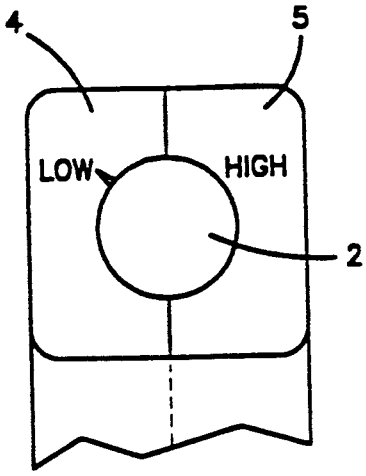
FIG. 2 is a rear view of the timing analyzer of FIG. 1, with portions omitted.

Accordingly, when the timing analyzer is used with a conventional four stroke engine, the variable sensitivity knob is set to a low sensitivity, as shown in FIG. 2, wherein the input threshold level is increased and the timing analyzer produces pulses of light only on the relatively larger current spikes produced by spark plug ignition, and rejects the lower current spikes caused by noise on the lead.

Alternatively, when the timing analyzer is used with a DIS four stroke engine, the variable sensitivity knob is set to a high sensitivity, wherein the analyzer produces pulses of light during the relatively lower current spikes in the spark plug leads. Moreover, the variable sensitivity knob can be set such that the analyzer is triggered only on the slightly higher current spikes produced during the compression stroke, and not on the slightly lower current spikes produced during the exhaust stroke.

Consequently, the variable sensitivity knob provides the timing analyzer with the ability to manually custom-tailor the input level trigger to the particular internal combustion engine being tested. In a conventional four stroke engine, the timing analyzer can be set to trigger at a relatively high threshold, which rejects any noise on the spark plug leads. In the DIS four stroke engine, however, the timing analyzer can be set to trigger at a relatively low level, which compensates for the relatively low current spikes in the DIS engine. In either case, the timing analyzer will produce a series of light pulses that can be used to accurately measure ignition timing. Moreover, since the timing analyzer can be adjusted so that the light pulses are firing at relatively the same rate for both the conventional and DIS four stroke engine, the timing analyzer can be visually checked by service personnel before use to determine if the analyzer is operating properly.

The principals, preferred embodiment and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention set forth in the appended claims.

What is claimed is:

1. A timing analyzer for testing ignition timing in a conventional four stroke and a DIS four stroke engine, comprising:

a pickup having means for sensing the current level on a spark plug lead in the vehicle;

means for producing a pulse of light when the current level increases above a pre-selected threshold level; and a variable sensitivity device having means to variably increase or decrease said threshold level in accordance with the characteristics of the engine being tested, such that the means for producing provides a pulse of light only when a pre-selected current threshold level is met for that engine.

2. The timing analyzer as in claim 1, wherein said means for variably increasing or decreasing the threshold level includes a trigger circuit, said trigger circuit including a variable resistance means to increase or decrease said threshold level.

3. The timing analyzer as in claim 2, wherein said variable sensitivity device includes a knob in registering relationship with said variable resistance means.

4. The timing analyzer as in claim 3, wherein said trigger circuit further includes SCR means, said SCR means providing a trigger pulse to said means for producing a pulse of light when the current level on the spark plug lead increases above the pre-selected current threshold level.

5. The timing analyzer as in claim 1, wherein said means for producing a pulse of light includes xenon lamp means.

6. A timing analyzer as in claim 1, wherein the conventional four stroke engine provides a relatively higher signal level in the pickup and the DIS four stroke engine provides a relatively lower signal level in the pickup, said threshold level being selectively variable in accordance with the signal level provided in the pickup in the engine being tested.

7. A timing analyzer as in claim 6, wherein the DIS four stroke engine provides slightly higher signal levels in the pickup during a compression stroke and slightly lower signal levels during an exhaust stroke, said threshold level being selectively variable such that the means for producing a pulse of light provides a pulse of light only when the signal level in the pickup is above the signal level during the exhaust stroke but is below the signal level during the compression stroke.

8. A timing analyzer as in claim 4, wherein said variable resistance means determines the resistance in said trigger circuit and the current level at which said SCR means provides the trigger pulse to said means for producing a pulse of light.

9. A timing analyzer as in claim 8, wherein said variable sensitivity device further includes means for adapting to a particular signal polarity in said means for sensing the current level.

10. A timing analyzer as in claim 9, wherein said means for sensing the current level on a spark plug lead includes means for inductively sensing the current level.

11. A method for testing ignition timing in a conventional four stroke and a DIS four stroke engine, comprising the steps of:

sensing the current level in a spark plug lead in the engine, preselecting a threshold current level by variably increasing or decreasing the threshold level in accordance with the characteristics of the engine being tested, producing a pulse of light when the current level in the spark plug lead increases above said pre-selected threshold level.

12. A timing analyzer as in claim 11, wherein said step of sensing the current level in the spark plug lead comprises sensing the current level in the spark plug lead using a pickup.

13. A timing analyzer as in claim 12, further including the steps of pre-selecting relatively higher signal levels in the pickup for the conventional four stroke engine, and relatively lower signal levels for the DIS four stroke engine.

14. A timing analyzer as in claim 13, wherein said step of pre-selecting the relatively lower signal levels for the DIS four stroke engine comprises pre-selecting signal levels above the slightly lower signal levels in the pickup during an exhaust stroke but below the slightly higher signal levels in the pickup during a compression stroke.

* * * * *